US011203511B2

(12) United States Patent
Yuan et al.

(10) Patent No.: US 11,203,511 B2
(45) Date of Patent: Dec. 21, 2021

(54) TRACTION SYSTEM FOR ELEVATOR AND ELEVATOR SYSTEM

(71) Applicant: Otis Elevator Company, Farmington, CT (US)

(72) Inventors: WeiHua Yuan, Hangzhou (CN); Changke Yang, Hangzhou (CN); LiuDi Gong, Hangzhou (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 482 days.

(21) Appl. No.: 16/169,500

(22) Filed: Oct. 24, 2018

(65) Prior Publication Data

US 2019/0127182 A1 May 2, 2019

(30) Foreign Application Priority Data

Oct. 27, 2017 (CN) ..... 201711021607.8

(51) Int. Cl.

| | |
|---|---|
| ***B66B 11/00*** | (2006.01) |
| ***B66B 7/06*** | (2006.01) |
| ***B66B 15/04*** | (2006.01) |

(52) U.S. Cl.

CPC ..... *B66B 11/008* (2013.01); *B66B 7/06* (2013.01); *B66B 15/04* (2013.01)

(58) Field of Classification Search

CPC ..... B66B 11/008; B66B 7/06; B66B 7/062
See application file for complete search history.

(56) References Cited

U.S. PATENT DOCUMENTS

| | | | |
|---|---|---|---|
| 5,351,788 | A | 10/1994 | Dejong |
| 7,117,977 | B2 | 10/2006 | Shigeru |
| 7,549,514 | B2 | 6/2009 | Heggli et al. |
| 7,938,233 | B2 | 5/2011 | Kunz |
| 9,321,612 | B2 | 4/2016 | Fargo et al. |

(Continued)

FOREIGN PATENT DOCUMENTS

| | | | |
|---|---|---|---|
| CN | 102134034 A | | 7/2011 |
| CN | 102398830 A | * | 4/2012 |

(Continued)

OTHER PUBLICATIONS

Machine Translation of CN 102398830 A.*

(Continued)

*Primary Examiner* — Diem M Tran
(74) *Attorney, Agent, or Firm* — Cantor Colburn LLP

(57) ABSTRACT

An elevator traction system and an elevator system. The elevator traction system includes: a car side wheel train; a transition wheel train; a counter-weight side wheel train; and a rope including a first end and a second end that are fixed to the top of a hoistway, the rope passing through the car side wheel train, the transition wheel train, and the counter-weight side wheel train sequentially, the car side wheel train including a first sheave and a third sheave that are fixed to the top of a car and a second sheave that is fixed to the top of the hoistway, wherein the first sheave and the third sheave are arranged to be parallel to each other and perpendicular to the second sheave. The elevator traction system and the elevator system according to embodiments of the present invention have a compact layout and a high hoistway utilization rate.

18 Claims, 3 Drawing Sheets

(56) References Cited

U.S. PATENT DOCUMENTS

| | | | | |
|---|---|---|---|---|
| 9,371,212 | B2 | 6/2016 | Yapar | |
| 2002/0000348 | A1* | 1/2002 | Faletto | B66B 11/008 187/277 |
| 2008/0121468 | A1* | 5/2008 | Fischer | B66B 11/008 187/256 |
| 2011/0042169 | A1 | 2/2011 | Faletto | |
| 2013/0327596 | A1* | 12/2013 | Fargo | B66B 7/062 187/266 |
| 2017/0217731 | A1 | 8/2017 | Liebetrau | |

FOREIGN PATENT DOCUMENTS

| | | | |
|---|---|---|---|
| CN | 203938340 | U | 11/2014 |
| CN | 104709800 | A | 6/2015 |
| CN | 107089579 | A | 8/2017 |
| EP | 1641698 | A1 | 4/2006 |
| EP | 1754680 | A1 | 2/2007 |
| EP | 1641701 | B1 | 3/2012 |
| JP | 2010116254 | A | 5/2010 |
| JP | 2012001308 | A | 1/2012 |
| WO | 9943593 | A1 | 9/1999 |
| WO | 2005000729 | A1 | 1/2005 |
| WO | 2012050993 | A1 | 4/2012 |

OTHER PUBLICATIONS

Zarahh Group, "Technical Guide", available at: http://www.zarahh.com/technical-guide.php, accessed: Oct. 23, 2018, 3 pages.
European Search Report for application 18202004.0, dated Mar. 28, 2019, U321022EP, 7 pages.
European Search Report for Application No. 182020040.0; dated Dec. 4, 2020; 5 Pages.

* cited by examiner

TRACTION SYSTEM FOR ELEVATOR AND ELEVATOR SYSTEM

FOREIGN PRIORITY

This application claims priority to Chinese Patent Application No. 201711021607.8, filed Oct. 27, 2017, and all the benefits accruing therefrom under 35 U.S.C. § 119, the contents of which in its entirety are herein incorporated by reference.

TECHNICAL FIELD

The present invention relates to the field of elevator systems, and in particular, to an elevator traction system having a unique sheave layout structure and a related elevator system.

BACKGROUND ART

In a 4:1 elevator traction system, as a traction wheel rotates a rope by 1 m, a counter-weight or a car is displaced by ¼ m. The Chinese Utility Model Patent Publication No. CN102134034A has disclosed a 4:1 elevator traction system, which is applicable to cargo elevators. In the application, a guide wheel is additionally disposed so that a section of the rope is vertical. FIG. 1 shows a top view of the structure. As can be seen from the top view, five sheaves including a side guide wheel 2, a pair of car top wheels 1 and 3, a traction wheel 4, and a guide wheel 5 are arranged side by side horizontally. Moreover, a side guide wheel 7 at the counter-weight side and a pair of counter-weight wheels 6 and 8 are arranged side by side vertically and are arranged on one side of a plane where the above five sheaves are located. As a result, the counter-weight is arranged at one side of a hoistway of the elevator.

SUMMARY OF THE INVENTION

The present invention is directed to solve or at least alleviate the problems in the prior art; according to some aspects, the present invention is directed to provide an elevator traction system having a compact structure and a high hoistway utilization rate and an elevator system, especially a 4:1 elevator traction system and an elevator system.

According to other aspects, the present invention is directed to implement a double-door elevator system in a small hoistway condition, especially an elevator system having a 4:1 elevator traction system.

In order to achieve the above objectives, an elevator traction system is provided according to some embodiments, including: a car side wheel train; a transition wheel train; a counter-weight side wheel train; and a rope including a first end and a second end that are fixed to the top of a hoistway, the rope passing through the car side wheel train, the transition wheel train, and the counter-weight side wheel train sequentially, the car side wheel train including a first sheave and a third sheave that are fixed to the top of a car and a second sheave that is fixed to the top of the hoistway, wherein the first sheave and the third sheave are arranged to be parallel to each other and perpendicular to the second sheave.

According to some aspects, an elevator system is provided, and the elevator system includes the elevator traction system according to the embodiments of the present invention.

BRIEF DESCRIPTION OF THE DRAWINGS

Content disclosed in the present invention will be more easily understood with reference to the accompanying drawings. It should be easily understood by those skilled in the art that these accompanying drawings are merely used for illustration rather than limiting the protection scope of the present invention. Moreover, similar numerals in the drawings are used to represent similar components, wherein.

DETAILED DESCRIPTION

It is easily understood that those of ordinary skill in the art can propose various interchangeable structural modes and implementation manners without changing the essential spirit of the present invention. Therefore, the following specific implementation manners and accompanying drawings are exemplary illustrations of the technical solutions of the present invention and should not be considered as all of the present invention or considered as definitions or limitations to the technical solutions of the present invention.

Orientation terms such as upper, lower, left, right, front, rear, front, back, top, and bottom that are or might be mentioned in the specification are used for definition with respect to constructions shown in the accompanying drawings, and they are relative concepts and are possibly changed correspondingly according to their different positions and different use states. Therefore, these or other orientation terms should not be construed as limitative terms.

Figure 1:
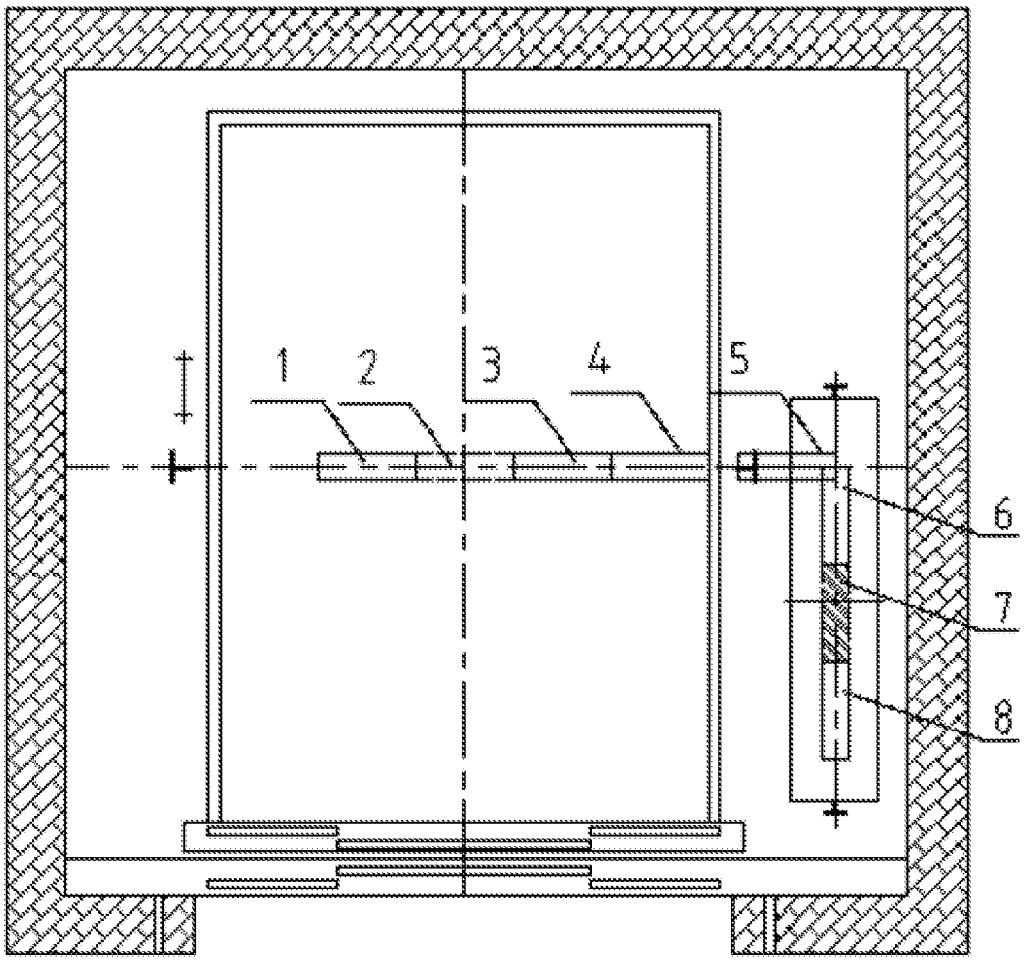
FIG. 1 shows a top view of an elevator traction system according to the prior art.
Figure 2:
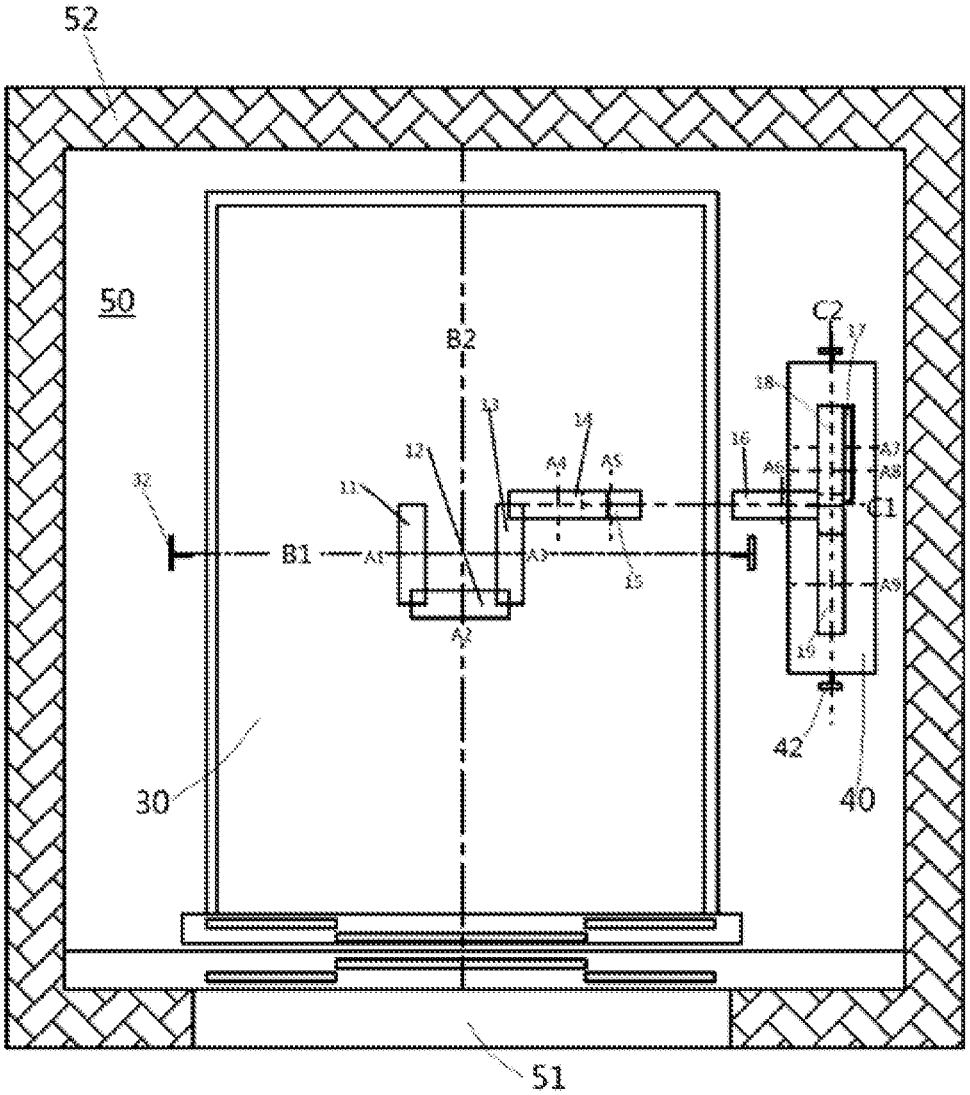
FIG. 2 shows a top view of an elevator traction system according to an embodiment of the present invention.
Figure 3:
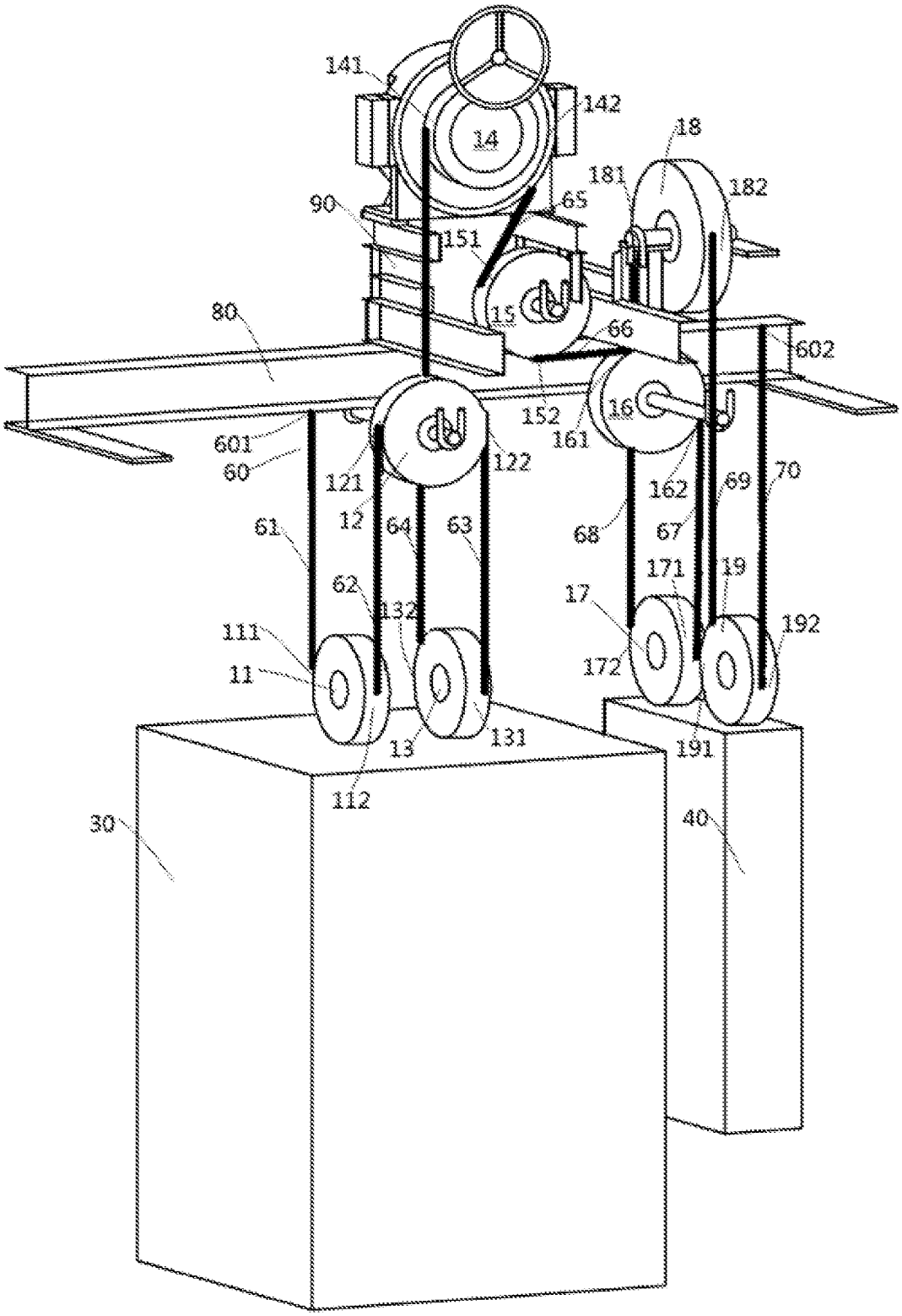
FIG. 3 shows a three-dimensional view of an elevator traction system according to an embodiment of the present invention.

Referring to FIG. 2 and FIG. 3, a top view and a three-dimensional view of an elevator system including an elevator traction system according to an embodiment of the present invention are shown respectively. In order to improve the hoistway utilization rate, the present application provides an improved elevator traction system layout and an elevator system having the elevator traction system layout. The elevator system includes a hoistway 50 that is defined by boundaries such as walls, a car 30 moving along a guide rail 32 in the hoistway, a counter-weight 40 moving along a guide rail 42 in the hoistway, and an elevator traction system that is arranged at the top of the hoistway, on the car, and on the counter-weight. The elevator traction system can adopt, for example, a 4:1 layout. The elevator traction system mainly includes: a car side wheel train, a transition wheel train, a counter-weight side wheel train, and a rope. The rope 60 includes a first end 601 and a second end 602 that are fixed to the top of the hoistway, and the rope passes through the car side wheel train, the transition wheel train, and the counter-weight side wheel train sequentially.

The car side wheel train includes a first sheave 11 and a third sheave 13 that are fixed to the top of the car and a second sheave 12 that is fixed to the top of the hoistway, wherein the first sheave 11 and the third sheave 13 are arranged to be parallel to each other and perpendicular to the second sheave 12. The first sheave 11 and the third sheave 13 can be fixed to the top of the car through brackets. The second sheave 12 can be fixed to a spandrel girder 80 at the top of the hoistway, as shown in FIG. 3. In the embodiment of the present invention, layout orientations of the first sheave 11 and the third sheave 13 are changed, thus greatly reducing the space occupation of the car side wheel train and improving the hoistway occupancy rate of the car side wheel train.

In the embodiment shown in the drawing, a spin axis A1 of the first sheave 11 and a spin axis A3 of the third sheave 13 are arranged to be collinear. In some embodiments, the spin axis A1 of the first sheave 11 and the spin axis A3 of the third sheave 13 are located in a plane of the guide rail of the car, i.e., in a plane defined by the guide rail 32 of the car. In the embodiment shown in the drawing, the spin axis A1 of the first sheave 11 and the spin axis A3 of the third sheave 13 are arranged at a horizontal center line B1 at the top of the car. It should be understood that, although the guide rail plane and the horizontal center line B1 at the top of the car are overlapped in the embodiment shown in the drawing, the two may not be overlapped in an alternative embodiment. In some embodiments, a spin axis A2 of the second sheave 12 is arranged at a longitudinal center line B2 at the top of the car. In some embodiments, a plane where the second sheave 12 is located is parallel to the guide rail plane and/or parallel to and separated from the horizontal center line B1 of the car.

In some embodiments, the first end 601 of the rope 60 is fixed to the top of the hoistway, e.g., on the spandrel girder 80, such that a rope section 61 between the first end 601 of the rope and the first sheave 11 is kept vertical. In some embodiments, a first side 121 of the second sheave 12 is located right above a second side 112 of the first sheave 11, such that a rope section 62 between the first sheave 11 and the second sheave 12 is kept vertical. In some embodiments, a second side 122 of the second sheave 12 is located right above a first side 131 of the third sheave 13, such that a rope section 63 between the second sheave 12 and the third sheave 13 is kept vertical. Based on such a layout, the first sheave 11, the second sheave 12, and the third sheave 13 form a C-shaped structure in the top view of FIG. 2. It should be understood that keeping a part of the rope vertical will more easily balance the force applied to the sheave, thus avoiding problems such as rope deflection.

In some embodiments, the transition wheel train can include a first transition sheave 14 and a second transition sheave 16 that are disposed at the top of the hoistway and separated apart. The transition wheel train is configured for transition between the car side wheel train and the counter-weight side wheel train and can provide a traction force for the whole elevator traction system. For example, in the embodiment shown in the drawing, the first transition sheave 14 is used as a driving traction wheel to provide torque output.

In some embodiments, the first transition sheave 14 and the second transition sheave 16 are located in the same plane and are parallel to the second sheave 12. In some embodiments, the plane where the first transition sheave 14 and the second transition sheave 16 are located is perpendicular to the third sheave 13. In some embodiments, the transition wheel train further includes a tension sheave 15 between the first transition sheave 14 and the second transition sheave 16. The tension sheave 15 is disposed to be located in a plane the same as that of the first transition sheave 14 and the second transition sheave 16 and is disposed to increase a wrap angle between the rope and the first transition sheave 14 and/or second transition sheave 16. Because of the layout of the car side wheel train of the present invention, compared with the prior art, a span between the car side wheel train and the counter-weight side wheel train may be increased, and the additionally disposed tension sheave 15 improves the wrap angle between the rope and the transition sheave, thus ensuring the tension force of the rope and preventing the rope from deflecting. More specifically, in the embodiment shown in the drawing, the tension sheave 15 is disposed such that the rope passes through the first transition sheave 14 along an S-shaped path. The tension sheave 15 and the second transition sheave 16 significantly increase the wrap angle between the rope and the sheave, thus increasing the tension force of the rope. In some embodiments, the first transition sheave 14, the second transition sheave 16, and the tension sheave 15 are supported at different heights by brackets 90 on the spandrel girder 80 at the top of the hoistway, such that the first transition sheave 14 is higher than the tension sheave 15, and the tension sheave 15 is higher than the second transition sheave 16. In some embodiments, the tension sheave 15 is disposed such that a lower edge 152 thereof is aligned with an upper edge 161 of the second transition sheave 16, and a rope section 66 between the tension sheave 15 and the second transition sheave 16 is basically horizontal. In some embodiments, a first side 141 of the first transition sheave 14 is located right above a second side 132 of the third sheave 13, such that a rope section 64 between the third sheave 13 and the first transition sheave 14 is kept vertical.

In some embodiments, the counter-weight side wheel train includes a fourth sheave 17 and a sixth sheave 19 that are disposed at the top of the counter-weight 40 and a fifth sheave 18 that is disposed at the top of the hoistway. In some embodiments, the fourth sheave 17, the fifth sheave 18, and the sixth sheave 19 are located in the same plane. In some embodiments, the plane where the fourth sheave 17, the fifth sheave 18, and the sixth sheave 19 are located is parallel to the plane where the first sheave and the third sheave are located and is perpendicular to the plane where the first transition sheave 14, the second transition sheave 16, and the tension sheave 15 are located. In some embodiments, the fourth sheave 17, the fifth sheave 18, and the sixth sheave 19 are arranged in a guide rail plane of the counter-weight, i.e., a plane where the guide rail 42 of the counter-weight are located. In a summary of some embodiments, the fourth sheave 17, the fifth sheave 18, and the sixth sheave 19 are arranged at a longitudinal center line C2 of the counter-weight.

In some embodiments, a first side 171 of the fourth sheave 17 is located right below a second side 162 of the second transition sheave 16, such that a rope section 67 between the second transition sheave 16 and the fourth sheave 17 is kept vertical. In some embodiments, the fifth sheave 18 is located right above the fourth sheave 17 and has a diameter greater than that of the fourth sheave 17, and a first side 181 of the fifth sheave 18 is aligned with a second side 172 of the fourth sheave 17, such that a rope section 68 between the fourth sheave 17 and the fifth sheave 18 is kept vertical. Moreover, a second side 182 of the fifth sheave 18 is aligned with a first side 191 of the sixth sheave 19, such that a rope section 69 between the fifth sheave 18 and the sixth sheave 19 is kept vertical. As can be seen from the top view, with respect to projections in a horizontal plane, a spin axis A8 of the fifth sheave 18 is located between a spin axis A7 of the fourth sheave 17 and a spin axis A9 of the sixth sheave 19. Such a layout avoids that the counter-weight side sheaves are arranged side by side at one side of the horizontal center line of the car, and the counter-weight is also allowed to be arranged in the middle of the hoistway, thus being conducive to arranging a double-door elevator system in a narrow hoistway. Benefiting from the structure of the present invention, a double-door elevator system can be arranged in a shallow hoistway. In some embodiments, the fifth sheave 18 is supported by a bracket on the spandrel girder 80, and the fifth sheave 18 is located at a position higher than the second transition sheave 16.

Further, the present invention further provides an elevator system, and the elevator system adopts the elevator traction system according to the embodiments of the present application. Specifically, the elevator system includes a car 30 and a car side wheel train located at the top of the car, a counter-weight 40 and a counter-weight side wheel train located at the top of counter-weight, and a transition wheel train. In some embodiments, the elevator system is a double-door elevator system, and the counter-weight 40 is arranged at one side of the elevator car 30. That is, another elevator inlet opposite to an elevator inlet 51 can be defined at the back 52 of the elevator system shown in FIG. 2.

The specific embodiments described above are merely used to describe the principles of the present invention more clearly, and components are clearly shown or described such that the principles of the present invention are more easily comprehensible. Those skilled in the art can easily make various modifications or changes on the present invention without departing from the scope of the present invention. Therefore, it should be understood that these modifications or changes should all be encompassed in the patent protection scope of the present invention.

What is claimed is:

1. An elevator traction system, comprising:

a car side wheel train;

a transition wheel train;

a counter-weight side wheel train; and a rope comprising a first end and a second end that are fixed to the top of a hoistway, the rope passing through the car side wheel train, the transition wheel train, and the counter-weight side wheel train sequentially, the car side wheel train comprising a first sheave and a third sheave that are fixed to the top of a car and a second sheave that is fixed to the top of the hoistway, wherein the first sheave and the third sheave are arranged to be parallel to each other and perpendicular to the second sheave;

wherein the transition wheel train comprises a first transition sheave and a second transition sheave that are disposed separately at the top of the hoistway;

wherein the transition wheel train further comprises a tension sheave between the first transition sheave and the second transition sheave, the tension sheave is disposed to be located in a plane the same as that of the first transition sheave and the second transition sheave, and the tension sheave is disposed to increase a wrap angle between the rope and the first transition sheave and/or second transition sheave.

2. The elevator traction system according to claim 1, wherein spin axes of the first sheave and the third sheave are arranged to be collinear.

3. The elevator traction system according to claim 2, wherein the spin axes of the first sheave and the third sheave are located in a car guide rail plane that is defined by a guide rail of the car.

4. The elevator traction system according to claim 2, wherein the spin axes of the first sheave and the third sheave are arranged on a horizontal center line of the top of the car.

5. The elevator traction system according to claim 1, wherein a spin axis of the second sheave is arranged on a longitudinal center line of the top of the car.

6. The elevator traction system according to claim 1, wherein a first side of the second sheave is located right above a second side of the first sheave, such that a rope section between the first sheave and the second sheave is kept vertical, and/or a second side of the second sheave is located right above a first side of the third sheave, such that a rope section between the second sheave and the third sheave is kept vertical.

7. The elevator traction system according to claim 1, wherein the second sheave is supported by a spandrel girder at the top of the hoistway.

8. The elevator traction system according to claim 1, wherein the first transition sheave, the second transition sheave, and the tension sheave are supported at different heights by brackets on the spandrel girder at the top of the hoistway, such that the first transition sheave is higher than the tension sheave, and the tension sheave is higher than the second transition sheave.

9. The elevator traction system according to claim 8, wherein a first side of the first transition sheave is located right above a second side of the third sheave, such that a rope section between the third sheave and the first transition sheave is kept vertical.

10. The elevator traction system according to claim 1, wherein the counter-weight side wheel train comprises a fourth sheave and a sixth sheave that are disposed at the top of a counter-weight and a fifth sheave that is disposed at the top of the hoistway.

11. The elevator traction system according to claim 10, wherein the fourth sheave, the fifth sheave, and the sixth sheave are located in the same plane.

12. The elevator traction system according to claim 10, wherein the fourth sheave, the fifth sheave, and the sixth sheave are arranged in a counter-weight guide rail plane that is defined by a guide rail of the counter-weight.

13. An elevator system, comprising the elevator traction system according to claim 1.

14. An elevator traction system, comprising:

a car side wheel train;

a transition wheel train;

a counter-weight side wheel train; and a rope comprising a first end and a second end that are fixed to the top of a hoistway, the rope passing through the car side wheel train, the transition wheel train, and the counter-weight side wheel train sequentially, the car side wheel train comprising a first sheave and a third sheave that are fixed to the top of a car and a second sheave that is fixed to the top of the hoistway, wherein the first sheave and the third sheave are arranged to be parallel to each other and perpendicular to the second sheave;

wherein the transition wheel train comprises a first transition sheave and a second transition sheave that are disposed separately at the top of the hoistway;

wherein the first transition sheave and the second transition sheave are located in the same plane and are parallel to the second sheave.

15. An elevator traction system, comprising:

a car side wheel train;

a transition wheel train;

a counter-weight side wheel train; and a rope comprising a first end and a second end that are fixed to the top of a hoistway, the rope passing through the car side wheel train, the transition wheel train, and the counter-weight side wheel train sequentially, the car side wheel train comprising a first sheave and a third sheave that are fixed to the top of a car and a second sheave that is fixed to the top of the hoistway, wherein the first sheave and the third sheave are arranged to be parallel to each other and perpendicular to the second sheave;

wherein the counter-weight side wheel train comprises a fourth sheave and a sixth sheave that are disposed at the top of a counter-weight and a fifth sheave that is disposed at the top of the hoistway;

wherein the fourth sheave, the fifth sheave, and the sixth sheave are parallel to the first sheave and the third sheave.

16. An elevator traction system, comprising:

a car side wheel train;

a transition wheel train;

a counter-weight side wheel train; and a rope comprising a first end and a second end that are fixed to the top of a hoistway, the rope passing through the car side wheel train, the transition wheel train, and the counter-weight side wheel train sequentially, the car side wheel train comprising a first sheave and a third sheave that are fixed to the top of a car and a second sheave that is fixed to the top of the hoistway, wherein the first sheave and the third sheave are arranged to be parallel to each other and perpendicular to the second sheave;

wherein the counter-weight side wheel train comprises a fourth sheave and a sixth sheave that are disposed at the top of a counter-weight and a fifth sheave that is disposed at the top of the hoistway;

wherein the transition wheel train comprises a first transition sheave and a second transition sheave that are disposed at the top of the hoistway, a first side of the fourth sheave is located right below a second side of the second transition sheave, such that a rope section between the second transition sheave and the fourth sheave is kept vertical.

17. The elevator traction system according to claim 16, wherein the fifth sheave is located right above the fourth sheave, and a first side of the fifth sheave is aligned with a second side of the fourth sheave, such that a rope section between the fourth sheave and the fifth sheave is kept vertical; the fifth sheave has a diameter greater than that of the fourth sheave, and a second side of the fifth sheave is located right above a first side of the sixth sheave, such that a rope section between the fifth sheave and the sixth sheave is kept vertical.

18. The elevator traction system according to claim 16, wherein the fifth sheave is supported by a bracket on the spandrel girder, and the fifth sheave is located at a position higher than the second transition sheave.

* * * * *